US007084840B2

(12) United States Patent
Moon

(10) Patent No.: US 7,084,840 B2
(45) Date of Patent: Aug. 1, 2006

(54) LIQUID CRYSTAL DISPLAY DEVICE

(75) Inventor: Seung-Hwan Moon, Seoul (KR)

(73) Assignee: Samsung Electronics Co., Ltd., Suwon (KR)

( * ) Notice: Subject to any disclaimer, the term of this patent is extended or adjusted under 35 U.S.C. 154(b) by 605 days.

(21) Appl. No.: 09/970,992

(22) Filed: Oct. 5, 2001

(65) Prior Publication Data

US 2002/0060655 A1 May 23, 2002

(30) Foreign Application Priority Data

Nov. 22, 2000 (KR) ..... 2000-69723

(51) Int. Cl.
*G09G 3/36* (2006.01)

(52) U.S. Cl. ..... 345/87; 345/100; 349/149

(58) Field of Classification Search ..... 345/87, 345/100, 96, 211–213; 349/149–150
See application file for complete search history.

(56) References Cited

U.S. PATENT DOCUMENTS 4,511,950 A * 4/1985 Bunner et al. ..... 361/413
4,630,122 A * 12/1986 Morokawa ..... 348/792
4,816,816 A * 3/1989 Usui ..... 345/103
5,729,316 A * 3/1998 Yamamura et al. ..... 349/150
5,881,299 A * 3/1999 Nomura et al. ..... 713/324
6,061,246 A * 5/2000 Oh et al. ..... 361/749
6,111,621 A * 8/2000 Kim et al. ..... 349/54
6,157,357 A * 12/2000 Kim ..... 345/87
6,307,530 B1 * 10/2001 Cho ..... 345/87
6,525,718 B1 * 2/2003 Murakami et al. ..... 345/206
6,559,822 B1 * 5/2003 Okuzono ..... 345/96
2001/0043174 A1 * 11/2001 Jacobsen et al. ..... 345/87

FOREIGN PATENT DOCUMENTS

JP 6-348231 12/1994

* cited by examiner

*Primary Examiner*—Patrick N. Edouard
*Assistant Examiner*—Kimnhung Nguyen

(57) ABSTRACT

Disclosed is a liquid crystal display device in which printed circuit board (PCB) modules are suitably arranged to form a large screen with high resolution. The liquid crystal display device includes first and second main PCBs for driving a dual bank type liquid crystal panel, the first main PCB having a timing controller for processing external odd input signals to generate driving signals, and sending part of the driving signals to a corresponding source driver PCB, so as to generate video signals to be supplied to the odd pixels of the liquid crystal panel; and the second main PCB having a timing controller for processing external even input signals to generate driving signals, and sending part of the driving signals to a corresponding source driver PCB, so as to generate video signals to be supplied to the even pixels of the liquid crystal panel. According to the present invention, two source driver PCBs are used to supply video data to the upper part and the lower part of the liquid crystal panel, respectively, and thereby to reduce signal delay and distortion in driving the dual bank type liquid crystal display device for a large screen with high resolution, thus solving the problems of coupling between signals more deviating from the tolerance range with an increased frequency, noise, and EMI.

10 Claims, 4 Drawing Sheets

LIQUID CRYSTAL DISPLAY DEVICE

BACKGROUND OF THE INVENTION (a) Field of the Invention

The present invention relates to a liquid crystal display device and, more particularly, to a liquid crystal display device in which printed circuit board (PCB) modules are suitably arranged to form a large screen with a high resolution.

(b) Description of the Related Art

In general, the liquid crystal display device includes a liquid crystal display module composed of a liquid crystal panel having a plurality of liquid crystal cells arranged in a matrix form between two glass substrates, and a back light unit disposed on the backside of the liquid crystal panel opposite to the display side; a PCB module disposed on the backside of the back light unit opposite to the display side; and a case for protecting and integrating those modules. Particularly, the PCB module is a driving circuit for processing externally applied red (R), green (G) and blue (B) video data and sync signals to supply video data, scanning signals and timing control signals to the liquid crystal panel, so as to allow the liquid crystal panel to successfully display application images such as computer images, television (TV) images, etc. The PCB module comprises a plurality of PCB's, and a plurality of flexible printed cables (FPC's) for signal transmission between the PCB's.

As is apparent from the schematic circuit diagram of a conventional liquid crystal display device as shown in FIG. 1, the PCB module, which is disposed on the backside of the display of the liquid crystal panel 50 to drive the liquid crystal panel 50 and has a relatively low resolution in the order of SVGA (600*800), comprises a main PCB 10 for processing externally applied RGB video data and sync signals by means of a timing-controller (T-con) which is a custom integrated circuit (IC) in the form of a flat pin grid array (FPGA), to generate video data and various control signals suitable to the structure of the liquid crystal panel; a gate driver PCB 20 equipped with a gate driver IC tape automated bond (TAB) for supplying a scanning signal based on the gate driver control signal received from the main PCB 10; and source driver PCB's 30 and 40 equipped with a source driver IC TAB for supplying video data based on the video data processed from the main PCB 10 and the control signals. The FPC, which is flexible cable for connecting the PCB's for signal transmission, includes an FPC that is to transmit various gate driver control signals 60 and 61 generated from the main PCB 10 to the gate driver PCB 20; a second FPC that is to transmit various source driver control signals 70 and 71 generated from the main PCB 10 to the source driver PCB's 30 and 40; and a third FPC that is to interconnect at least two main PCB's 10 which are separated from each other.

However, as the display device has a larger screen with higher resolutions such as XGA (768*1024), SXGA (1024*1280) and UXGA (1200*1600), some problems occur in regard to the width of data lines provided on the lower plate of the liquid crystal panel 50, the space for installing the source driver PCB's 70 and 71 and the driver IC TAB's provided on the lower plate of the liquid crystal panel 50, a rise of the data processing rate that requires a separate drive, etc. As such, the mostly used liquid crystal display device is of a dual bank type, which uses two separate source driver PCB's 70 and 71 that are respectively provided on the upper and lower part of the backside of the liquid crystal panel 50 to supply video data to the upper and lower parts of the liquid crystal panel 50.

FIG. 2 shows a PCB module of the conventional dual bank type liquid crystal display device for a large screen with a high resolution.

The dual bank type liquid crystal display device as shown in FIG. 2 has a liquid crystal display module 100; source drivers 110 and 120 provided on the backside of the display and connected to the upper and lower parts of the display by a main PCB 140 and FPC's 150 and 170; and a gate driver PCB 130 laterally connected to the main PCB 140 via FPC 160. The main PCB 140 has a timing controller for processing video data received via an external video data input signal line 180, and for supplying various data and control signals to the source driver 110 and 120 and the gate driver 130 via the FPC's 150, 160 and 170.

The above-described dual bank type PCB module as shown in FIG. 2 processes video data to form a large screen with high resolution in a bipartite drive manner, as follows. First, the main PCB 140 has a timing controller for processing video data from the external video data input signal line 180 to generate video data and various control signals, and sending them to the corresponding source driver PCB's 110 and 120. Here, the video data, i.e., R2*n*-1, B2*n*-1 and G2*n* are sent to the source driver PCB 110 on the upper side of the display via the FPC 150, and the video data, i.e., G2*n*-1, R2*n* and B2*n* are sent to the source driver PCB 120 on the lower side of the display via the FPC 170, so that the video data are displayed on the pixels of the liquid crystal panel in the order as shown in FIG. 3 as viewed from the front side of the display of the liquid crystal panel. Besides, the signals sent via the FPC's 150 and 170 include various control signal to be supplied to the source driver IC TAB as well as video data.

However, such a method in which various control signals in addition to video data are sent via the FPC's 150 and 170 to drive the liquid crystal panel on a large screen with high resolution incurs many problems in regard to coupling between signals more deviating from a tolerance range at an increased frequency, noises, and electromagnetic interference (EMI). Besides, when connecting PCB's with FPC's 150 and 170, the resistance capacitance (RC) intrinsic delay component caused by the coupling resistance between the PCB and FPC connectors and the other parasitic capacitance component results in both signal delay and signal distortion. Hence, an inadequate timing control between signals supplied to the source driver PCB's 110 and 120 provided on the upper and lower parts of the liquid crystal display module 100 makes setting and holding of video data inadequate to display. This causes noises or line defect on the liquid crystal display and, for the worse, provides a display that cannot be recognized. In particular, this problem becomes worse due to the longer FPC 170 shown in FIG. 2 rather than the shorter FPC 150.

SUMMARY OF THE INVENTION

It is an object of the present invention to provide a configuration of the PCB module to reduce signal delay and distortion in driving a liquid crystal panel for a large screen with a high resolution.

In one aspect of the present invention to achieve the above object, there is provided a liquid crystal display device including a main printed circuit board (PCB) for driving a dual bank type liquid crystal panel, wherein the main PCB includes: a first main PCB having a timing controller for processing external odd input signals to generate driving signals, and sending part of the driving signals to a corresponding source driver PCB, so as to generate video signals to be supplied to the odd pixels of the liquid crystal panel; and a second main PCB having a timing controller for processing external even input signals to generate driving signals, and sending part of the driving signals to a corresponding source driver PCB, so as to generate video signals to be supplied to the even pixels of the liquid crystal panel.

In another aspect of the present invention, there is provided a liquid crystal display device including a main PCB for driving a dual bank type liquid crystal panel, wherein the main PCB includes: a first main PCB having a timing controller for processing odd input signals among externally input signals to generate driving signals, and sending part of the driving signals to a corresponding source driver PCB, so as to generate video signals to be supplied to the odd pixels of the liquid crystal panel; and a second main PCB having a timing controller for processing even input signals received from the first main PCB via a cable to generate driving signals, and sending part of the driving signals to a corresponding source driver PCB, so as to generate video signals to be supplied to the even pixels of the liquid crystal panel.

In still another aspect of the present invention, there is provided a liquid crystal display device including a main PCB for driving a dual bank type liquid crystal panel, wherein the main PCB includes: a first main PCB having a timing controller for processing even input signals among externally input signals to generate driving signals, and sending part of the driving signals to a corresponding source driver PCB, so as to generate video signals to be supplied to the even pixels of the liquid crystal panel; and a second main PCB having a timing controller for processing odd input signals received from the first main PCB via a cable to generate driving signals, and sending part of the driving signals to a corresponding source driver PCB, so as to generate video signals to be supplied to the odd pixels of the liquid crystal panel.

Preferably, the externally input signals include low-voltage data signals (LVDS).

Preferably, either the first main PCB or the second main PCB is connected to a gate driver PCB via a cable so as to send part of the generated driving signals to a corresponding gate driver PCB.

Consequently, the present invention uses the above-described PCB module arrangement to reduce signal delay and distortion in driving a dual bank type liquid crystal display device in which two source driver PCBs are respectively provided on the upper and lower backsides of the display of the liquid crystal panel to supply video data to the upper part and the lower part of the liquid crystal panel, thereby successfully driving a liquid crystal display panel for a large screen and a high resolution.

BRIEF DESCRIPTION OF THE DRAWINGS

The accompanying drawings, which are incorporated in and constitute a part of the specification, illustrate an embodiment of the invention, and, together with the description, serve to explain the principles of the invention.

DETAILED DESCRIPTION OF THE PREFERRED EMBODIMENTS

In the following detailed description, only the preferred embodiment of the invention has been shown and described, simply by way of illustrating the best mode contemplated by the inventor(s) of carrying out the invention. As will be realized, the invention is capable of modification in various obvious respects, all without departing from the invention. Accordingly, the drawings and description are to be regarded as illustrative in nature, and not restrictive.

Figure 4:
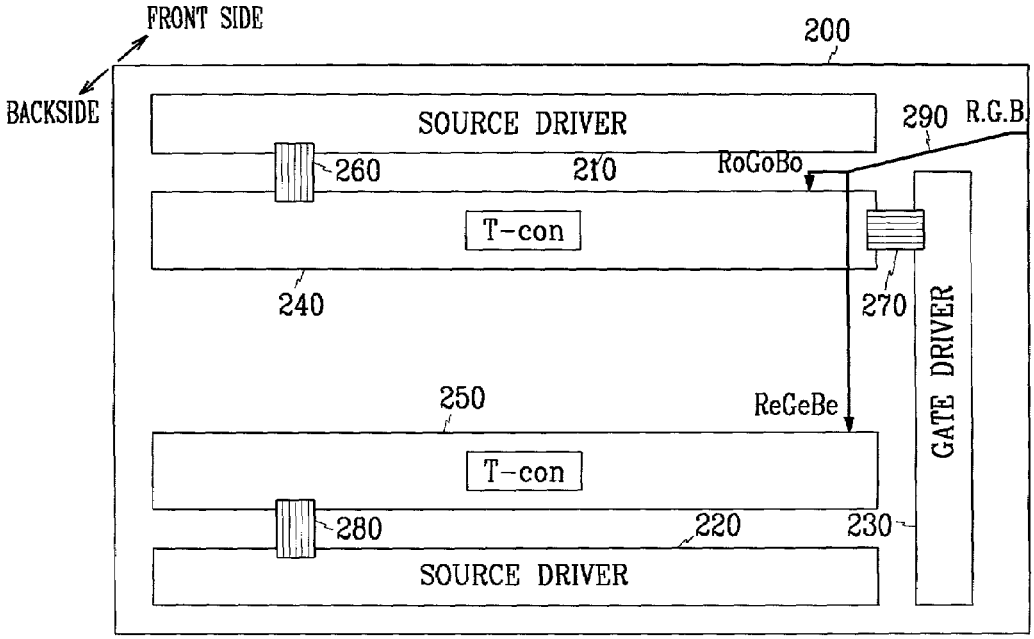
FIG. 4 is a diagram illustrating a liquid crystal display device according to a first embodiment of the present invention.

FIG. 4 shows a liquid crystal display device according to a first embodiment of the present invention.

As shown in FIG. 4, the liquid crystal display device according to the first embodiment of the present invention comprises a liquid crystal display module 200, a first source driver PCB 210 a second source driver PCB 220, a gate driver PCB 230, a first main PCB 240, a second main PCB 250, a first source FPC 260, a second source FPC 280, a gate FPC 270, and an external input signal line 290.

The liquid crystal display module 200 comprises, as in the usual cases, a liquid crystal panel having liquid crystal cells arranged in the matrix form between two glass substrates, and a back light unit provided on the backside of the liquid crystal panel opposite to the display side.

The first source driver PCB 210 is provided with a source driver IC TAB for supplying odd video data, i.e., R2*n*-1, G2*n*-1 and B2*n*-1 (in FIG. 6) via a source line pad on the upper side of the liquid crystal panel based on a driving signal received from the first main PCB 240.

The second source driver PCB 220 is provided with a source driver IC TAB for supplying even video data, i.e., R2*n*, G2*n* and B2*n* (in FIG. 6) via a source line pad on the lower side of the liquid crystal panel based on a driving signal received from the second main PCB 250.

The gate driver PCB 230 is provided with a gate driver IC TAB for supplying a scanning signal based on a gate driver control signal received from the first main PCB 240.

The first main PCB 240 has a timing controller for processing odd input signals such as odd video signals Ro, Go and Bo, and sync signals received from the external input signal line 290 to generate driving signals, in order to generate video signals to be supplied to odd pixels of the liquid crystal panel, and thereby sends the corresponding driving signals to the first source driver PCB 210. The first main PCB 240 also sends power and various control signals for driving the gate driver IC TAB of the gate driver PCB 230 to the gate driver PCB 230 via the gate FPC 270.

The second main PCB 250 has a timing controller for processing even input signals such as even video signals Re, Ge and Be, and sync signals received from the external input signal line 290 to generate driving signals, in order to generate video signals to be supplied to even pixels of the liquid crystal panel, and sends the corresponding driving signals to the second source driver PCB 220.

The first source FPC 260 is a flexible cable for transmitting odd video data and various control signals generated from the first main PCB 240 to the first source driver PCB 210 in order to drive the source driver IC TAB of the first source driver PCB 210.

The second source FPC 280 is a flexible cable for transmitting even video data and various control signals generated from the second main PCB 250 to the second source driver PCB 220 in order to drive the source driver IC TAB of the second source driver PCB 220.

The gate FPC 270 is a flexible cable for transmitting power and various control signals generated from the first main PCB 240 to the gate driver PCB 230 in order to drive the gate driver IC TAB of the gate driver PCB 230. Here, the gate FPC 270 for driving the gate driver IC TAB of the gate driver PCB 230 may be provided between the second main PCB 250 and the gate driver PCB 230 in order to make power and various control signals generated at the second main PCB 250 and applied to the gate driver PCB 230.

Figure 1:
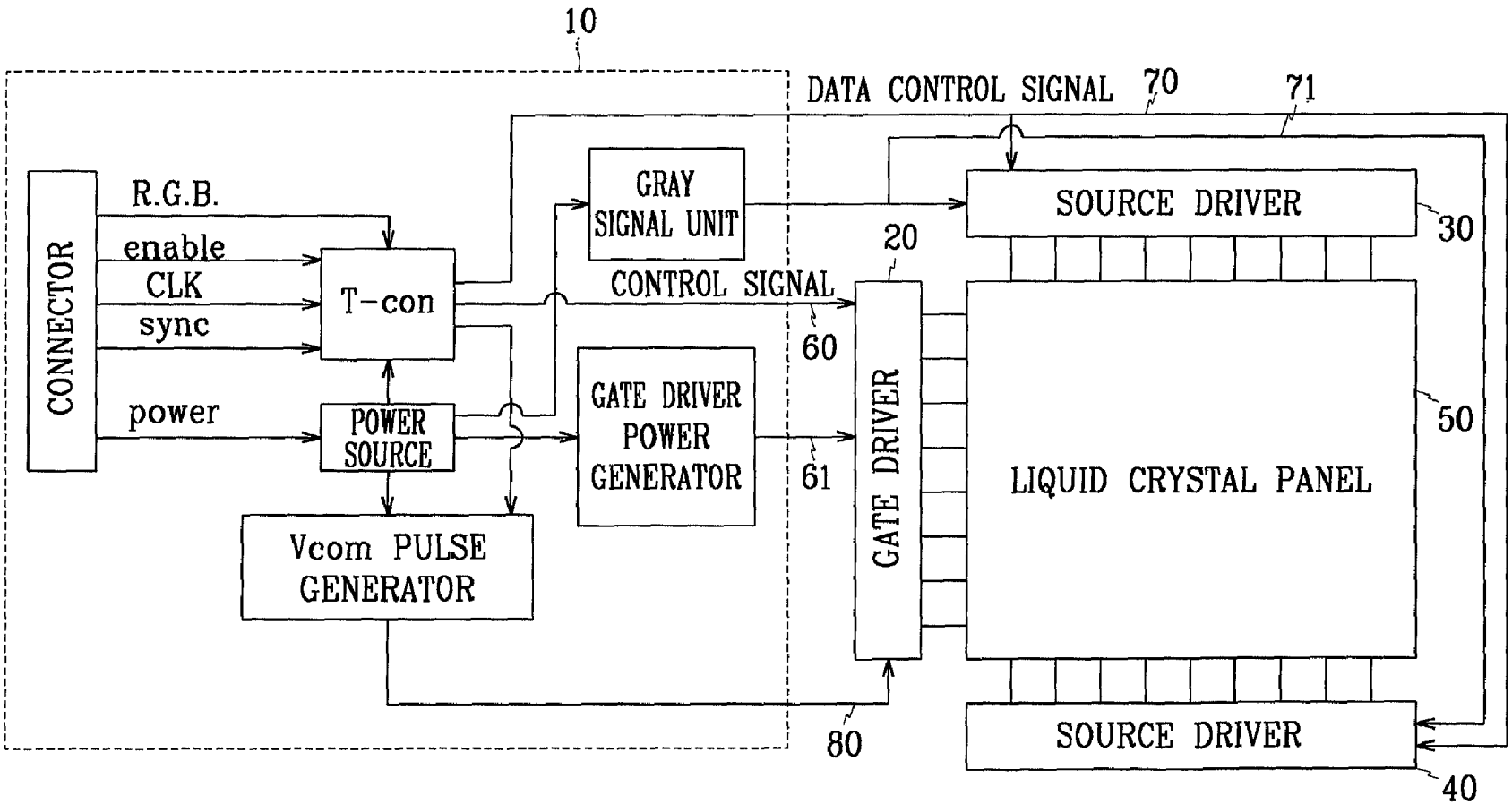
FIG. 1 (Prior Art)
FIG. 1 is a circuit diagram of a liquid crystal display device according to prior art.
Figure 2:
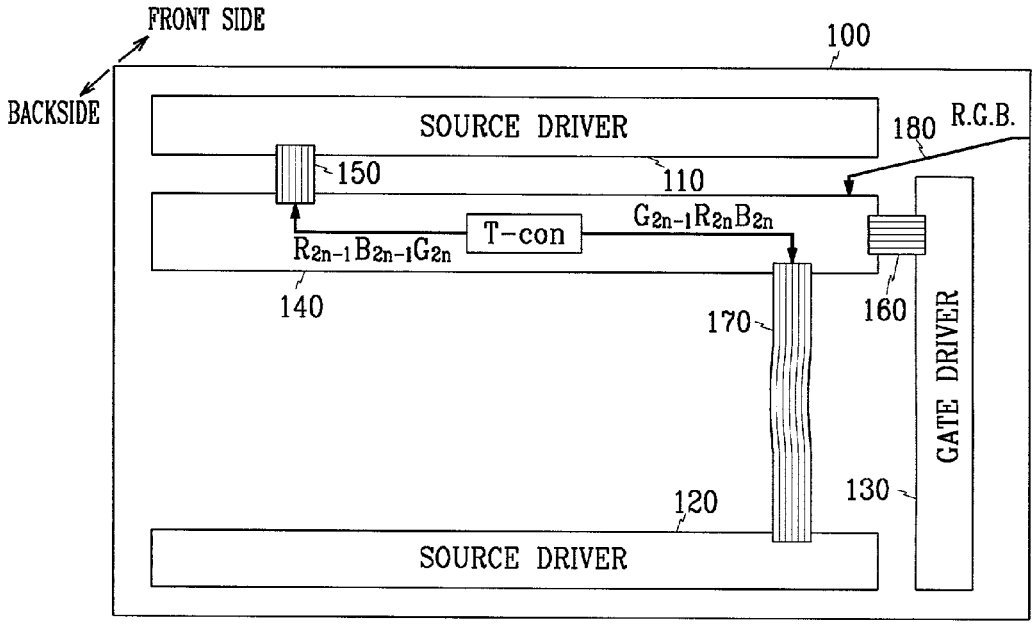
FIG.2(Prior Art)
FIG. 2 is a diagram illustrating a PCB module of the liquid crystal display device according to the prior art.
Figure 3:
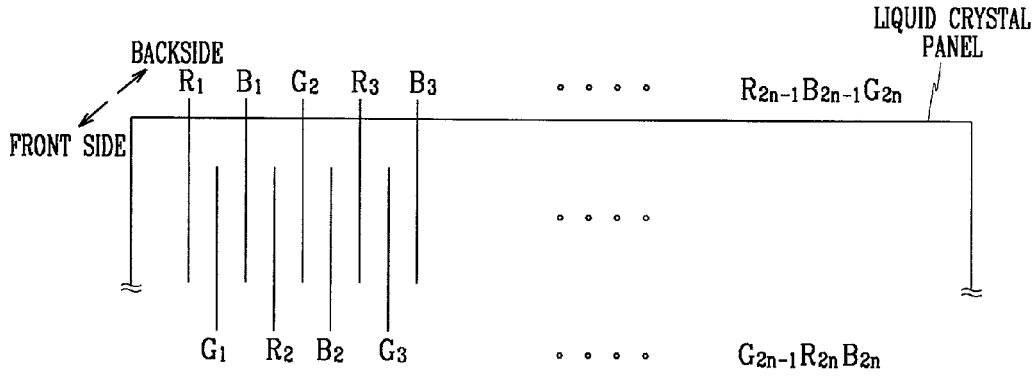
FIG.3(Prior Art)
FIG. 3 is a diagram illustrating an arrangement of video data supplied from a source driver when a liquid crystal panel according to prior art is viewed from the front side of the display.

The external input signal line 290, which is a cable for receiving various external signals in order to drive the liquid crystal panel, sends the corresponding signals to the first main PCB 240 and the second main PCB 250. Examples of the input signals include, as shown in FIG. 1, RGB video data signals, sync signals, system clock CLK, enable signals, and power. The RGB video data signals are divided into odd video data applied to the first main PCB 240 and even video data applied to the second main PCB 250. The other signals are input to both the first main PCB 240 and the second main PCB 250.

Now, a detailed description will be given on how the liquid crystal display device operates according to the first embodiment of the present invention as constructed above.

The dual bank type liquid crystal display device according to the first embodiment of the present invention as shown in FIG. 4 has the liquid crystal display module 200. The first and second source driver PCBs 210 and 220 are provided on the backside of the display and connected to the upper part and the lower part of the display by the first and second source FPCs 260 and 280 corresponding to the first and second main PCB's 240 and 250, respectively. The gate driver PCB 230 is laterally connected to the first main PCB 240 by the gate FPC 270. The first and second main PCBs 240 and 250 process external video data received via the input signal line 290 by way of their timing controller to supply various data and control signals to the source drivers PCBs 210 and 220 and the gate driver PCB 230 via the FPCs 260, 270 and 280, respectively.

Figure 6:
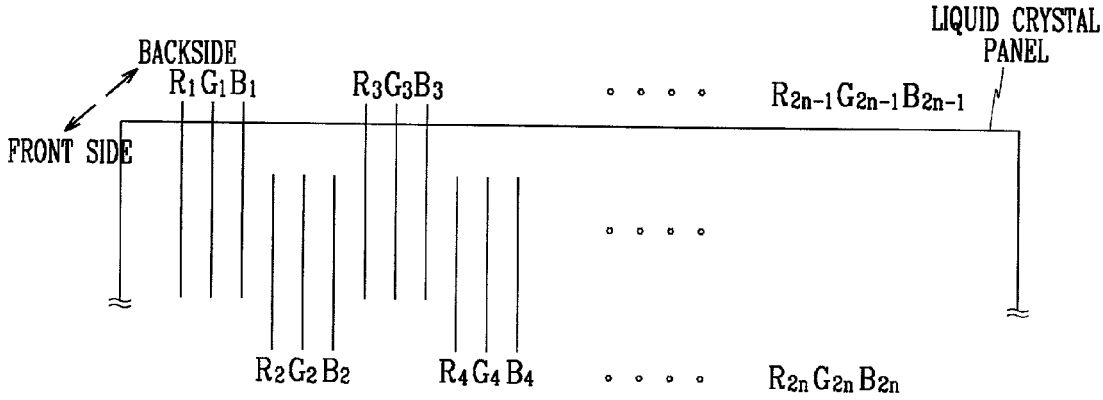
FIG. 6 is a diagram illustrating an arrangement of video data supplied from source drivers when a liquid crystal panel according to the first and second embodiments of the present invention is viewed from the front side of the display.

The above-described dual bank type PCB module according to the first embodiment of the present invention processes video data to form a large screen with high resolution in a bipartite drive manner as follows. First, the first main PCB 240 has its timing controller that processes odd video data such as odd input signals received from the external input signal line 290 to generate video data and various control signals and sends them to the first source driver PCB 210 via the first source FPC 260. The second main PCB 250 has its timing controller that processes even video data such as even input signals received from the external input signal line 290 to generate video data and various control signals and sends them to the second source driver PCB 220 via the second source FPC 280. The first main PCB 240 also generates power and various control signals for driving the gate driver IC TAB provided on the gate driver PCB 230 and sends them to the gate driver PCB 230 via the gate FPC 270. The gate FPC 270 for driving the gate driver IC TAB of the gate driver PCB 230 may be interposed between the second main PCB 250 and the gate driver PCB 230 in order to have the power and various control signals generated at the second main PCB 250 and applied to the gate driver PCB 230. Here, the odd video data, i.e., R2*n*-1, G2*n*-1 and B2*n*-1 generated from the first main PCB 240 are sent to the first source driver PCB 210 on the upper side of the display via the first source FPC 260, and the even video data, i.e., R2*n*, G2*n* and B2*n* generated from the second main PCB 250 are sent to the second source driver PCB 220 on the lower side of the display via the second source FPC 280, so that the video data are displayed on the pixels of the liquid crystal panel in the order as shown in FIG. 6 as viewed from the front side of the display of the liquid crystal panel.

Figure 5:
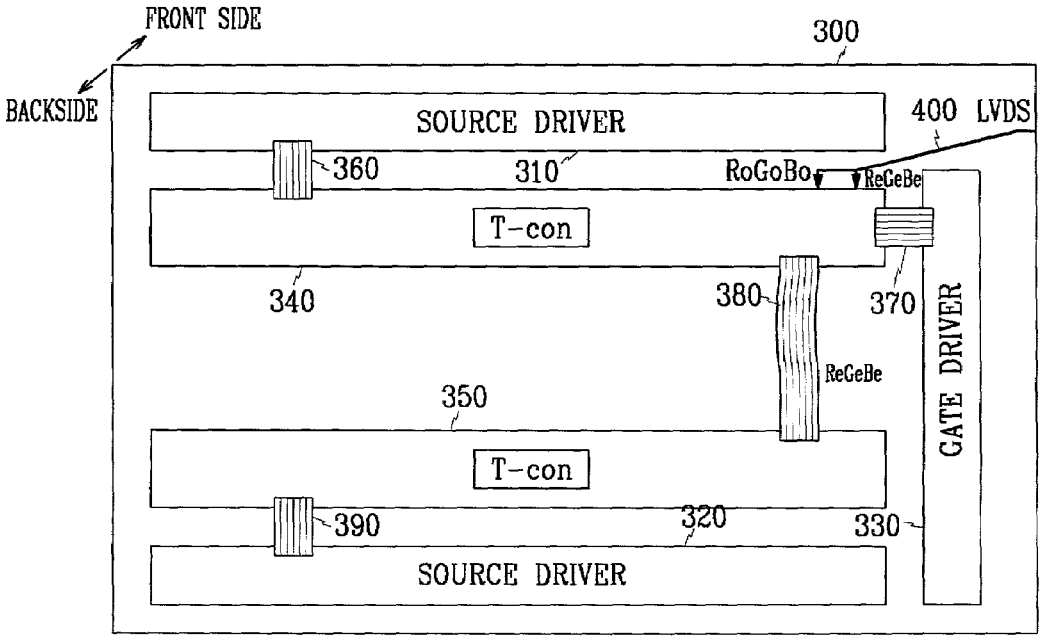
FIG. 5 is a diagram illustrating a liquid crystal display device according to a second embodiment of the present invention.

FIG. 5 shows a liquid crystal display device according to a second embodiment of the present invention.

As shown in FIG. 5, the liquid crystal display device according to the second embodiment of the present invention comprises a liquid crystal display module 300, a first source driver PCB 310, a second source driver PCB 320, a gate driver PCB 330, a first main PCB 340, a second main PCB 350, a first source FPC 360, a second source FPC 380, a third source FPC 390, a gate FPC 370, and an external input signal line 400.

The liquid crystal display module 300 comprises, as the liquid crystal display module 200 of FIG. 4, a liquid crystal panel having liquid crystal cells arranged in the matrix form between two glass substrates, and a back light unit provided on the backside of the liquid crystal panel opposite to the display side.

The first source driver PCB 310 is provided with a source driver IC TAB for supplying odd video data, i.e., R2*n*-1, G2*n*-1 and B2*n*-1 (in FIG. 6) via a source line pad on the upper side of the liquid crystal panel based on a driving signal received from the first main PCB 340.

The second source driver PCB 320 is provided with a source driver IC TAB for supplying even video data, i.e., R2*n*, G2*n* and B2*n* (in FIG. 6) via a source line pad on the lower side of the liquid crystal panel based on a driving signal received from the second main PCB 350.

The gate driver PCB 330 is provided with a gate driver IC TAB for supplying a scanning signal based on a gate driver control signal received from the first main PCB 340.

The first main PCB 340 has a timing controller for processing odd input signals such as odd video signals Ro, Go and Bo, and sync signals received from the external input signal line 400 to generate driving signals, so as to generate video signals to be supplied to odd pixels of the liquid crystal panel, and thereby sends the corresponding driving signals to the first source driver PCB 310. The first main PCB 340 also sends power and various control signals for driving the gate driver IC TAB of the gate driver PCB 330 to the gate driver PCB 330 via the gate FPC 370.

The second main PCB 350 has a timing controller for processing even input signals such as even video signals Re, Ge and Be, and sync signals received from the external input signal line 400 to generate driving signals, so as to generate video signals to be supplied to even pixels of the liquid crystal panel, and sends the corresponding driving signals to the second source driver PCB 320.

The first source FPC 360 is a flexible cable for transmitting odd video data and various control signals generated from the first main PCB 340 to the first source driver PCB 310 in order to drive the source driver IC TAB of the first source driver PCB 310.

The second source FPC 380 is a flexible cable for transmitting only even input signals among the various input signals, such as low-voltage video signals, as received via the external input signal line 400, from the first main PCB 340 to the second main PCB 350.

The third source FPC 390 is a flexible cable for transmitting even video data and various control signals generated from the second main PCB 350 to the second source driver PCB 320 in order to drive the source driver IC TAB of the second source driver PCB 320.

The gate FPC 370 is a flexible cable for transmitting power and various control signals generated from the first main PCB 340 to the gate driver PCB 330 in order to drive the gate driver IC TAB of the gate driver PCB 330. Here, the gate FPC 370 for driving the gate driver IC TAB of the gate driver PCB 330 may be provided between the second main PCB 350 and the gate driver PCB 330 in order to make power and various control signals generated at the second main PCB 350 and applied to the gate driver PCB 330.

The external input signal line 400 is a cable for receiving various external signals including low-voltage video signals for driving the liquid crystal panel to transmit the various input signals to the first main PCB 340 and the even signals among the externally input signals received via the external input signal line 400 from the first main PCB 340 to the second main PCB 350. Examples of the externally input signals include, as shown in FIG. 1, RGB video data signals, sync signals, system clock CLK, enable signals, and power. The RGB video data signals are divided into low-voltage odd video data applied to the first main PCB 340 and low-voltage even video data applied to the second main PCB 350. The other signals are input to both the first main PCB 340 and the second main PCB 350.

The dual bank type liquid crystal display device according to the second embodiment of the present invention as shown in FIG. 5 has the liquid crystal display module 300. The first and second source driver PCBs 310 and 320 are provided on the backside of the display and connected to the upper part and the lower part of the display by the first and second source FPCs 360 and 390 corresponding to the first and second main PCBs 340 and 350, respectively. The gate driver PCB 330 is laterally connected to the first main PCB 340 by the gate FPC 370. The first and second main PCBs 340 and 350 process external video data received via the input signal line 400 by means of their timing controller to supply various data and control signals to the source drivers PCB's 310 and 320 and the gate driver PCB 330 via the FPC's 360 to 390, respectively.

The above-described dual bank type PCB module according to the second embodiment of the present invention processes video data to form a large screen with high resolution in a bipartite drive manner as follows. First, the first main PCB 340 has its timing controller that processes odd input signals such as low-voltage odd video data received from the external input signal line 400 to generate video data and various control signals and sends them to the first source driver PCB 310 via the first source FPC 360. The second main PCB 350 has its timing controller that processes even input signals such as low-voltage even video data received from the external input signal line 400 to generate video data and various control signals and sends them to the second source driver PCB 320 via the third source FPC 390. The first main PCB 340 also generates power and various control signals for driving the gate driver IC TAB provided on the gate driver PCB 330 and sends them to the gate driver PCB 330 via the gate FPC 370. The gate FPC 370 for driving the gate driver IC TAB of the gate driver PCB 330 may be interposed between the second main PCB 350 and the gate driver PCB 330 so as to have the power and various control signals generated at the second main PCB 350 and applied to the gate driver PCB 330. Here, the odd video data, i.e., R2*n*-1, G2*n*-1 and B2*n*-1 generated from the first main PCB 340 are sent to the first source driver PCB 310 on the upper side of the display via the first source FPC 360, and the even video data, i.e., R2*n*, G2*n* and B2*n* generated from the second main PCB 350 are sent to the second source driver PCB 320 on the lower side of the display via the third source FPC 390, so that the video data are displayed on the pixels of the liquid crystal panel in the order as shown in FIG. 6 as viewed from the front side of the display of the liquid crystal panel.

The functions of the first and second main PCB's 340 and 350 may be inverted. That is, the first main PCB 340 has its timing controller process even input signals such as low-voltage even video data received from the external input signal line 400 to generate video data and various control signals and send them to the first source driver PCB 310 via the first source FPC 360; and the second main PCB 350 has its timing controller process odd input signals such as low-voltage odd video data received from the external input signal line 400 to generate video data and various control signals and send them to the second source driver PCB 320 via the third source FPC 390. Here, the even video data, i.e., R2*n*, G2*n* and B2*n* generated from the first main PCB 340 are sent to the first source driver PCB 310 on the upper side of the display via the first source FPC 360, and the odd video data, i.e., R2*n*-1, G2*n*-1 and B2*n*-1 generated from the second main PCB 350 are sent to the second source driver PCB 320 on the lower side of the display via the third source FPC 390, so that the video data are displayed on the pixels of the liquid crystal panel in the order as shown in FIG. 6 as viewed from the front side of the display of the liquid crystal panel.

The liquid crystal display device according to the embodiments of the present invention uses the above-described PCB module arrangement to reduce signal delay and distortion in driving a dual bank type liquid crystal display device in which two source driver PCBs are respectively provided on the upper and lower backsides of the display of the liquid crystal panel to supply video data to the upper part and the lower part of the liquid crystal panel, thereby successfully driving a liquid crystal display panel for a large screen with a high resolution.

As described above, the present invention has two main PCBs, i.e., a first main PCB to process odd video data and a second main PCB to process even video data, each of which includes a timing controller for generating various data and control signals to the corresponding source driver PCB via the FPC, so that each main PCB supplies the nearer source driver PCB with various data and control signals necessary to the corresponding source driver IC TAB via the FPC, thereby solving the problems of RC intrinsic delay, coupling between signals, noise and EMI, and reducing signal distortion.

While this invention has been described in connection with what is presently considered to be the most practical and preferred embodiment, it is to be understood that the invention is not limited to the disclosed embodiments, but, on the contrary, is intended to cover various modifications and equivalent arrangements included within the spirit and scope of the appended claims.

What is claimed is:

1. A liquid crystal display (LCD), comprising:

a display panel having a plurality of pixels divided into a first pixel group and a second pixel group;

a first main printed circuit board (PCB) having a first timing controller receiving a first input signal and generating a first driving signal;

a first source driver PCB receiving the first driving signal from the first main PCB and generating and supplying a first signal to the first pixel group;

a second main PCB having a second timing controller receiving a second input signal and generating a second driving signal; and a second source driver PCB receiving the second driving signal from the second main PCB and generating and supplying a second signal to the second pixel group.

2. The LCD of claim 1, wherein the first input signal and the second input signal include low-voltage data signals (LVDS).

3. The LCD of claim 1, further comprising a gate driver PCB receiving a third driving signal and generating and supplying a third signal to the plurality of pixels, wherein either the first main PCB or the second main PCB receives a third input signal and generates and supplies the third driving signal to the gate driver PCB.

4. The LCD of claim 1, wherein the first pixel group comprises the pixels arranged on odd columns and the second pixel group comprises the pixels arranged on even columns.

5. The LCD of claim 1, wherein one of the first main PCB or the second main PCB receives both the first input signal and the second input signal and supplies one of the first input signal and the second input signal to the other one of the first main PCB or the second main PCB.

6. A liquid crystal display (LCD), comprising:

a plurality of pixels divided into a first pixel group and a second pixel group;

a first signal controller receiving first input signals for the first pixel group and generating first video signals and first driving signals;

a second signal controller receiving second input signals for the second pixel group and generating second video signals and second driving signals;

a first source driver receiving the first video signals and the first driving signals from the first signal controller and supplying the first video signals to the first pixel group according to the first driving signals;

a second source driver receiving the second video signals and the second driving signals from the second signal controller and supplying the second video signals to the second pixel group according to the second driving signals; and a gate driver receiving third driving signals for scanning the pixels from one of the first signal controller and the second signal controller.

7. The LCD of claim 6, wherein the second signal controller receives the second input signals from the first signal controller.

8. The LCD of claim 6, wherein the first signal controller and the second signal controller are provided on respective main printed circuit boards (PCBs), and the first source driver and the second source driver are provided on respective source PCBs.

9. The LCD of claim 8, further comprising a gate driver provided on a gate PCB and receiving third driving signals for scanning the pixels from one of the first signal controller and the second signal controller.

10. The LCD of claim 6, wherein the first signal controller and the second signal controller are separated from each other.

* * * * *